US006231120B1

(12) United States Patent
Wiecek

(10) Patent No.: US 6,231,120 B1
(45) Date of Patent: May 15, 2001

(54) RECLINING MECHANISM AND FURNITURE ITEM

(75) Inventor: Glenn N. Wiecek, Shelbyville, KY (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 09/298,334

(22) Filed: Apr. 23, 1999

(51) Int. Cl.[7] ..... A47C 1/02
(52) U.S. Cl. ..... 297/84; 297/DIG. 7; 297/259.2
(58) Field of Search ..... 297/423.19, 423.2, 297/423.1, 68, 85, 259.2, DIG. 7, 83, 84

(56) References Cited

U.S. PATENT DOCUMENTS

| | | | | |
|---|---|---|---|---|
| 276,687 | | 5/1883 | Hartley . | |
| 649,383 | | 5/1900 | Wilcke | 297/70 |
| 2,169,550 | * | 8/1939 | Arends . | |
| 2,879,833 | | 3/1959 | Fletcher | 297/89 |
| 3,012,816 | | 12/1961 | Lorenz et al. | 297/85 |
| 3,039,814 | | 6/1962 | Schliephacke | 297/68 |
| 3,794,381 | | 2/1974 | Caldemeyer | 297/430 |
| 3,869,169 | * | 3/1975 | Johnson et al. . | |
| 4,226,468 | | 10/1980 | Johnson | 297/84 |
| 4,357,049 | | 11/1982 | Rogers, Jr. et al. | 297/75 |
| 4,506,925 | | 3/1985 | Crum | 297/69 |
| 4,531,778 | | 7/1985 | Rogers, Jr. | 297/85 |
| 4,577,902 | | 3/1986 | Crum | 297/85 |
| 4,715,654 | * | 12/1987 | Laskowitz . | |
| 4,844,536 | | 7/1989 | Mizelle | 297/68 |
| 4,895,411 | | 1/1990 | Pine | 297/88 |
| 4,904,019 | | 2/1990 | May | 297/85 |
| 5,007,679 | | 4/1991 | Mizelle | 297/374 |
| 5,013,084 | | 5/1991 | May | 297/85 |
| 5,141,284 | * | 8/1992 | LaPointe . | |
| 5,368,366 | * | 11/1994 | Mizelle . | |
| 5,388,886 | | 2/1995 | LaPointe et al. | 297/75 |
| 5,480,209 | | 1/1996 | May | 297/85 |
| 5,582,457 | | 12/1996 | Komorowski et al. | 297/75 |
| 5,653,498 | * | 8/1997 | Grandfield . | |

FOREIGN PATENT DOCUMENTS

| | | |
|---|---|---|
| 297 07 730 U | 7/1997 | (DE) . |
| 0680713A | 11/1995 | (EP) . |

* cited by examiner

*Primary Examiner*—Milton Nelson, Jr.
(74) *Attorney, Agent, or Firm*—Wood, Herron & Evans, L.L.P.

(57) ABSTRACT

A reclining mechanism for a furniture item includes support structure adapted for attachment to the furniture item, a footrest support bar connected for longitudinal movement with respect to the support structure between extended and retracted positions and actuating structure connected with the footrest support bar. The footrest support bar includes an S-shaped section and is connected to a footrest member for supporting the legs of the seat occupant. The actuating structure moves the footrest support bar along the S-shaped section between the extended and retracted positions to closely approximate a conventional footrest portion of a reclining mechanism, while presenting a simplified construction.

32 Claims, 7 Drawing Sheets

RECLINING MECHANISM AND FURNITURE ITEM

FIELD OF THE INVENTION

This invention generally relates to reclining furniture and, more specifically, to a three-way reclining furniture item having a moveable seat, backrest and footrest.

BACKGROUND OF THE INVENTION

Conventional reclining furniture items, such as chairs, sofas and sectionals, generally have either two-way or three-way mechanisms for allowing the chair to be moved between upright and reclined positions. In a two-way mechanism, the seat is fixed to the backrest as a unitary structure so that the angle between the seat and backrest remains the same during reclining motion. If the piece of furniture has a three-way mechanism, the top of the backrest will angle downwardly and rearwardly relative to the seat as the furniture item moves from an intermediate reclined or so-called T.V. position to a fully reclined position. Likewise, the backrest will move or tilt back up as the furniture item moves from the fully reclined position to the T.V. position. Among the concerns with reclining mechanisms in general are complexity and cost issues. These mechanisms can comprise large numbers of linkages and pivots to give the desired movement to the furniture item. Understandably, the more linkages and pivot connections in a given reclining mechanism, the higher the cost of manufacture and assembly. It has also become conventional practice to design reclining mechanisms with "zero wall proximity" ability. This refers to the ability to place the item of furniture with the top of the backrest against or very close to a wall while still allowing movement of the furniture item into both intermediate and fully reclined positions without encountering interference from the wall. Generally, the addition of this feature to a mechanism has even further complicated the typical three-way reclining mechanism. Another problem associated with reclining mechanisms has been the noise that they produce in moving between the different chair positions. Again, this noise can be associated with the numerous moving linkages in the mechanisms.

There have been many attempts to incorporate rollers in reclining mechanisms in various ways to produce mechanisms allowing different movements. For example, see U.S. Pat. Nos. 3,874,724; 4,072,342; 4,364,603; 4,531,778; and 5,823,614. One area of improvement that would be desirable relates to the footrest linkage of the mechanism. Conventionally, a scissor linkage assembly has been incorporated to extend and retract the footrest. Consumers have become widely familiar and comfortable with the typical footrest movement between the retracted and extended positions. However, the linkage assemblies have high numbers of links and pivots and present exposed pinch points. Certain consumers may also find them unattractive when in the extended position.

Alternative designs have been proposed to simplify the typical footrest scissor linkage, however, none of these alternatives have been fully acceptable. For example, alternative footrest mechanism constructions are shown in U.S. Pat. Nos. 4,506,925 and 4,844,536. In general, the mechanisms shown in these patents substitute bars which carry a footrest between retracted and extended positions using linkages, rollers or both. One major drawback with previous proposals such as these is that the resulting movement of the footrest does not closely approximate the typical movement of a footrest as refined through years of reclining mechanism development. This is believed to be one reason that these alternative footrest constructions have not been accepted in the industry.

In view of various problems with reclining mechanisms, such as three-way reclining mechanisms, it would be desirable to simplify these mechanisms and make them more attractive by significantly reducing the number of linkages in the footrest support and actuation portion, while also reducing costs, noise and potential pinch points associated with the mechanisms. At the same time, it would advantageous to provide a mechanism which fully reclines in a smooth manner without significant effort by the seat occupant and without interfering with a closely adjacent wall located behind the backrest.

SUMMARY OF INVENTION

The present invention improves upon past reclining mechanisms by incorporating a simplified footrest support bar and actuating system that closely approximates the typical arc-shaped movement of an extending and retracting footrest mechanism. In the preferred embodiment, a reclining mechanism is provided for a furniture item to allow movement between upright and reclined positions. More specifically, this may include one upright position and two reclined positions, typically referred to as an intermediate reclined position or T.V. position and a fully reclined position. The reclining mechanism generally includes support structure adapted for attachment to the furniture item, and a footrest support bar connected for longitudinal movement with respect to the support structure between extended and retracted positions. In the preferred embodiment, the support structure includes a track and the footrest support bar is connected for movement along the track. At least one of the track and the footrest support bar includes an S-shaped section. A first end of the footrest support bar is adapted for connection to a footrest member for supporting the legs of a seat occupant. Actuating structure is provided and connected with the footrest support bar and operates to move the footrest support bar along the S-shaped section between the extended and retracted positions.

In one advantageous and preferred configuration, the S-shaped section is on the footrest support bar. The S-shaped section of the footrest support bar functions to closely approximate the movement of a conventional footrest mechanism. Also, in furtherance of this advantage, the footrest support bar includes at least one roller attached for rotation thereto and the support structure further includes a track. The roller is mounted for movement along the track between the extended and retracted positions. In the preferred embodiment, the track includes at least one curved section between the first and second ends and, more preferably, the entire track curves upward and then downward from a rear portion to a front portion thereof.

While the support structure may take many forms, it preferably includes a seat supporting member mounted adjacent the footrest support bar in a manner allowing the actuating structure to travel along the track as the footrest support bar moves between the extended and retracted positions. The roller is attached proximate the second end of the footrest support bar and the track includes first and second stops, which may be the ends of the track, with the roller engaging the stops at the respective upright and reclined positions. In a three-way mechanism, the rollers will preferably engage the stops at the upright and intermediate reclined positions. The roller is connected for movement with the actuating structure along the track. At least one additional roller is connected to a front portion of the support structure adjacent the footrest support bar and engages the footrest support bar during movement between the extended and retracted positions. In the preferred embodiment, upper and lower rollers are connected to the front portion of the support structure. These upper and lower rollers will support and guide the footrest support bar during movement between the extended and retracted positions. As one alternative construction, the mechanism may include a rocker element connected with the support structure to allow rocking of the furniture item by an occupant. Many other options, such as a zero wall proximity option, gliding option, swivel option, etc., may also be incorporated into a mechanism of the present invention.

The invention also generally contemplates a method of operating a footrest mechanism in a reclining furniture item as generally described above. The method involves maintaining the footrest in a generally vertical orientation, moving the footrest support bar simultaneously downward and outward, reorienting the footrest into an angled orientation, extending the footrest support bar through an upwardly and outward arc while the footrest moves through the angled orientation, and stopping the footrest support bar with the footrest in the generally horizontal orientation at an upper end of the arc and the footrest support bar extending between the seat and the footrest. The method further involves retracting the footrest support bar through an opposite downward and inward arc while the footrest moves through the angled orientation and moving the footrest support bar upward and inward toward the seat as the footrest approaches the seat. The footrest stops in the generally vertical orientation in a typical position tucked beneath the seat.

The invention further contemplates a reclining mechanism similar to the above-described mechanism but either alternatively or additionally including a footrest member that is connected for biased, pivotal motion with respect to the footrest actuating structure, such as the S-shaped footrest support bar. In one aspect, the footrest member is connected by at least one spring to the footrest actuating structure and the spring is mounted for movement into an over-center position for pivoting the footrest member into a leg supporting position upon extension thereof. In another aspect, the footrest member is pivotally connected to the footrest actuating structure in a pivoting, spring-biased fashion allowing pivoting motion in two directions whereby the front edge of the footrest member is pivotal downward in the leg supporting position and the rear edge of the footrest member is pivotal outward in the retracted position. This allows the footrest to float in a spring-biased fashion in concert with movement of the seat occupant's legs in the extended position. Also, as the footrest member is retracted against the furniture item, the rear edge of the footrest member, which becomes the upper edge in the retracted position, can pivot in a spring-biased manner away from the furniture item in case of object, such as a person's body part, is caught between the footrest member and the remaining portions of the furniture item.

Additional features, objectives and advantages of the invention will be more readily appreciated from the description to follow, taken in conjunction with the accompanying drawings and the various configurations of the invention set forth in the appended claims.

DETAILED DESCRIPTION OF PREFERRED EMBODIMENTS

Figure 1:
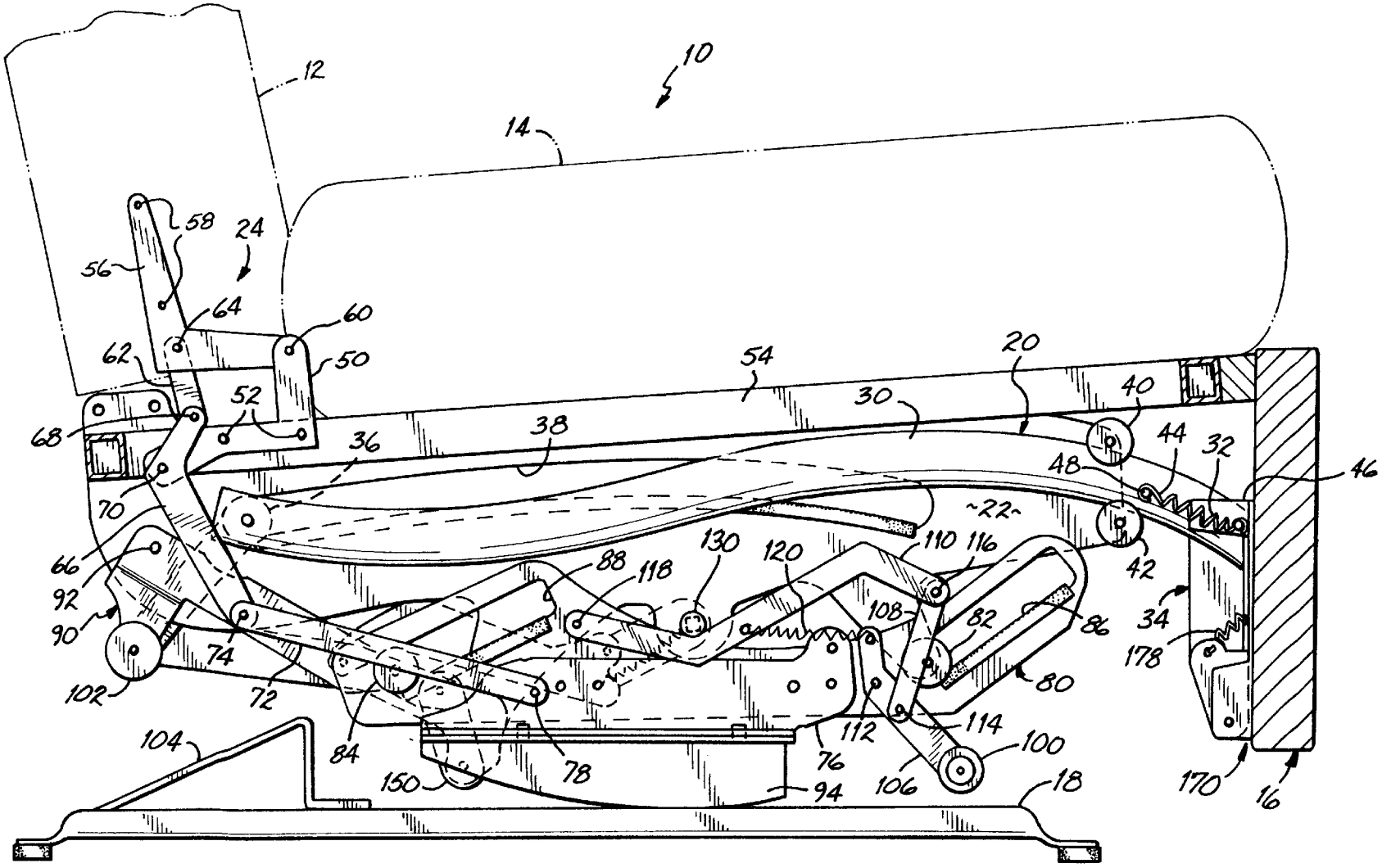
FIG. 1 is an elevational view of a schematically illustrated furniture item depicting a reclining mechanism constructed in accordance with the invention and shown from an inside perspective.
Figure 2:
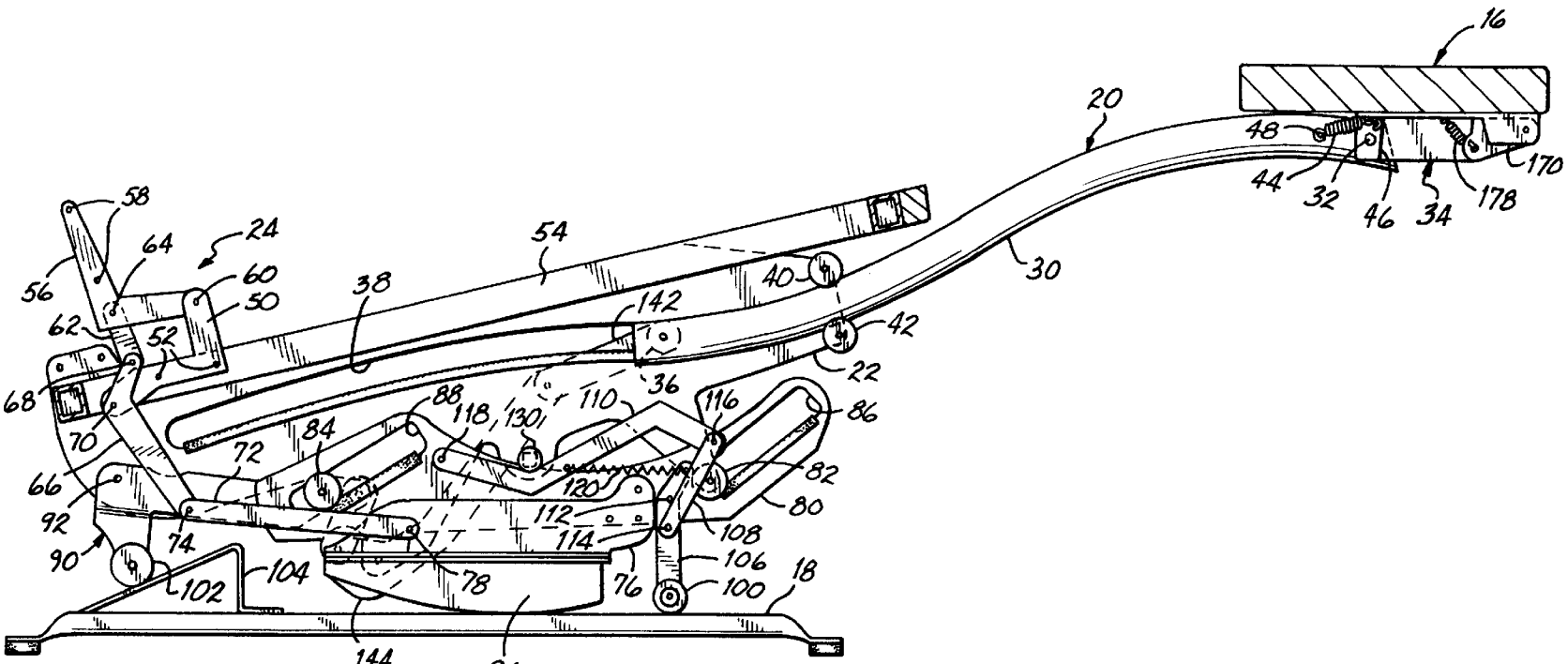
FIG. 2 is an elevational view of the reclining mechanism shown in FIG. 1, but illustrated in the intermediate reclined or T.V. position.
Figure 3:
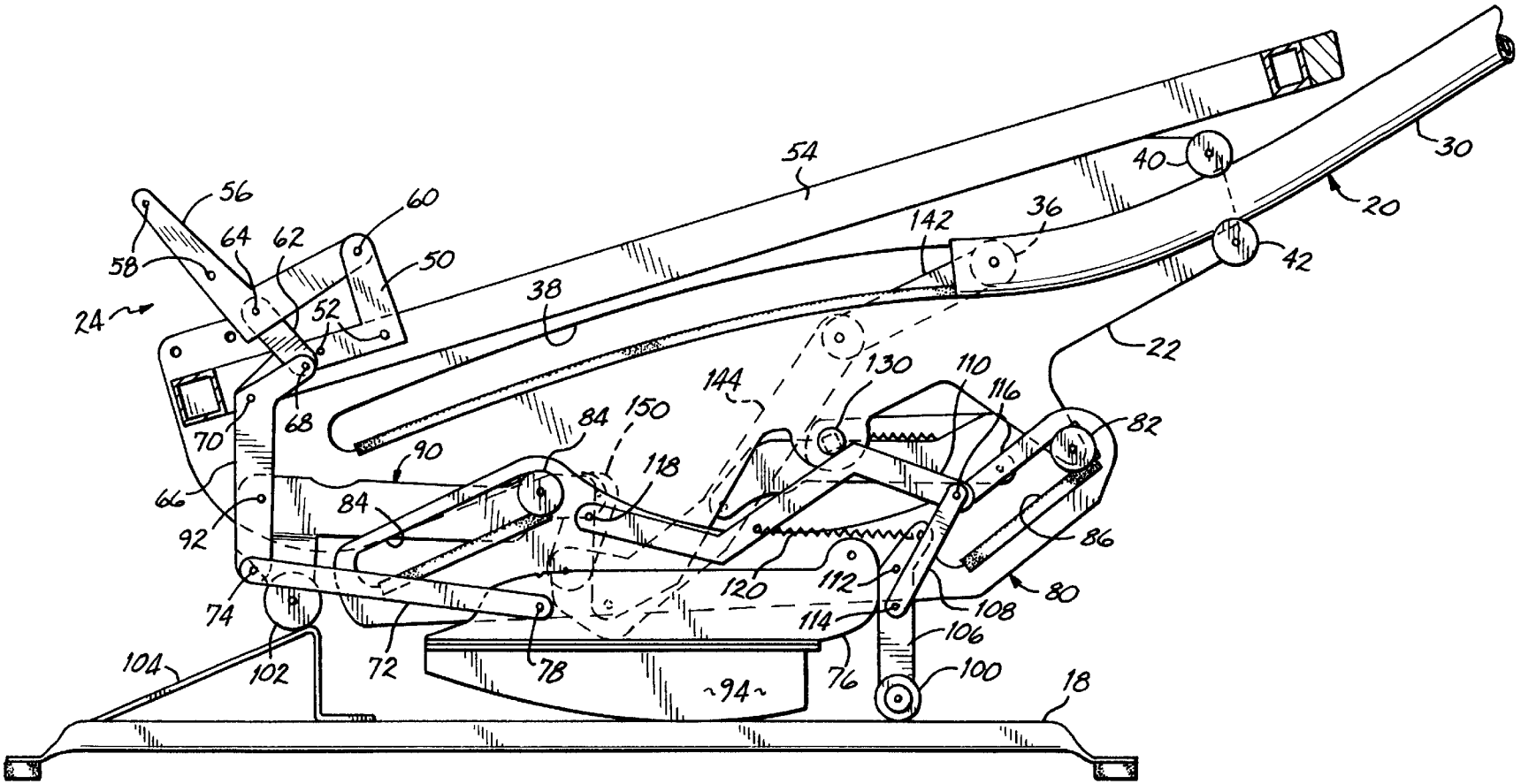
FIG. 3 is a fragmented elevational view similar to FIG. 2, but showing the mechanism in a fully reclined position.

Referring to FIGS. 1–3, a reclining furniture item 10 constructed in accordance with the preferred embodiment includes a schematically illustrated backrest 12 and seat 14. A footrest 16 is connected for extension and retraction in a manner to be described below. In this preferred embodiment, furniture item 10 is configured such that the backrest 12, seat 14 and footrest 16 move with respect to a base member 18 and by way of a reclining mechanism 20 between the fully upright position shown in FIG. 1 and respective intermediate reclined and fully reclined positions shown in FIGS. 2 and 3. It will be appreciated that many other mechanism configurations, including two-way and three-way mechanisms, may incorporate one or more features of this invention. It will also be understood that, as in the typical case, two reclining mechanisms will be used in a given item of furniture. These mechanisms will be mounted on opposite sides of seat 12 and will be mirror images of one another. Only a description of one mechanism 20 will be detailed herein with the understanding that another mirror image mechanism is connected on the opposite side of furniture item 10.

Reclining mechanism 20 includes a seat link or plate 22 connected for movement with seat 14 and backrest linkage 24 connected for movement with backrest 12. An S-shaped bar 30 has a front end connected by a pivot 32 to a support bracket 34 affixed to footrest 16. A second, opposite end of the S-shaped footrest support bar 30 includes a roller 36 connected for rotation therewith. Roller 36 is contained on a track which is preferably configured as a slot 38 contained within seat link 22. S-shaped footrest support bar 30 is further supported and guided at a front end of seat link 22 by upper and lower rollers 40, 42. These rollers engage footrest support bar 30 as it moves between retracted and extended positions as explained further below. A spring 44 is connected to a portion 46 of bracket 34 and further connected to a stud 48 extending from footrest support bar 30. Spring 44 is disposed above pivot 32 between bracket 34 and support bar 30 in essentially an on-center position when footrest 16 is in a retracted position. Spring 44 moves to an over-center position under the weight of a seat occupant's legs as footrest 16 moves to the extended position as shown in FIG. 2. Once in this position, footrest 16 can float in a spring-biased manner as shown in phantom in accordance with leg movement of the seat occupant.

Backrest linkage 24 includes a link 50 rigidly secured by fasteners 52 to a seat supporting tube structure 54. A pivoting backrest link 56 is rigidly affixed to backrest 12 by fasteners 58 and includes a pivot 60 at one end secured to link 50. Another link 62 has one end pivotally secured to backrest link 56 at a pivot connection 64 and has an opposite, lower end connected with a link 66 at a pivot connection 68. Link 66 is generally L-shaped and includes a pivot connection 70 with link 50. A lower end of link 66 is connected with a further link 72 at a pivot connection 74. Link 72 is connected at a front end to a base plate or link 76 by a pivot connection 78. Another base link 80 is rigidly affixed to base link 76 and serves to support seat link 22 and the attached seat 14. Forward and rearward movement of seat 14 with respect to base links 76, 80 is provided by front and rear rollers 82, 84 riding in respective front and rear tracks or slots 86, 88 contained in base link 80. As will be discussed below, this movement takes place between the T.V. or intermediate reclined position and the fully reclined position. It will be appreciated that rear roller 84 also moves independently of front roller 82 when going from the fully upright position (FIG. 1) to the T.V. or intermediate reclined position (FIG. 2). Front roller 82 is connected to seat link 22, while rear roller 84 is connected to a link 90 attached with seat link 22 by a pivot connection 92.

As further shown in FIGS. 1 and 2, a rocker element 94 is rigidly affixed to base link 76 and allows rocking motion of the backrest 12, seat 14 and footrest 16 with respect to base 1 8 when furniture item 10 is in the fully upright position shown in FIG. 1. As further shown in FIG. 2, front and rear rollers 100, 102 are provided to prevent rocking motion when furniture item 10 is moved into the intermediate reclined or T.V. position. In the T.V. position, rear roller 102 will engage a ramp 104 affixed to base member 18 and front roller 100 will directly engage base member 18. Rear roller 102 is connected to link 90, while front roller 100 is connected to a link 106. Link 106 is part of an overall linkage assembly which further includes links 108 and 110 connected so as to actuate roller 100 from the position shown in FIG. 1 to the position shown in FIG. 2 upon movement from the fully upright position (FIG. 1) to the intermediate reclined or T.V. position (FIG. 2). Link 106 is pivotally connected to base link 80 at pivot connection 112 and link 108 is connected by respective pivot connections 114, 116 to links 106 and 110. Link 110 is pivotally connected at an opposite end to base link 80 by a pivot connection 118. An extension spring 120 extends between an upper end of link 106 and a mid-portion of link 110. This serves to pivot roller 100 to the disengaged position shown in FIG. 1 when mechanism 20 is moved from the intermediate reclined position or T.V. position to the fully upright position.

A drive tube or torque tube which is typically connected to a handle for operation by a seat occupant engages an upper surface of link 110. It will be appreciated that actuation members or assemblies other than handles may be utilized. During movement from the fully upright position shown in FIG. 1 to the T.V. position shown in FIG. 2, seat link 22 will drop downward thereby pressing drive tube 130 against link 110 and rotating link 110 clockwise about pivot 118. This moves link 106 and roller 100 to the locking position shown in FIG. 2. Drive tube 130 rotates within a bushing contained within seat link 22. Drive tube 130 further serves to actuate footrest 16 between the retracted and extended positions upon rotation by the seat occupant as will be described below.

Figure 4:
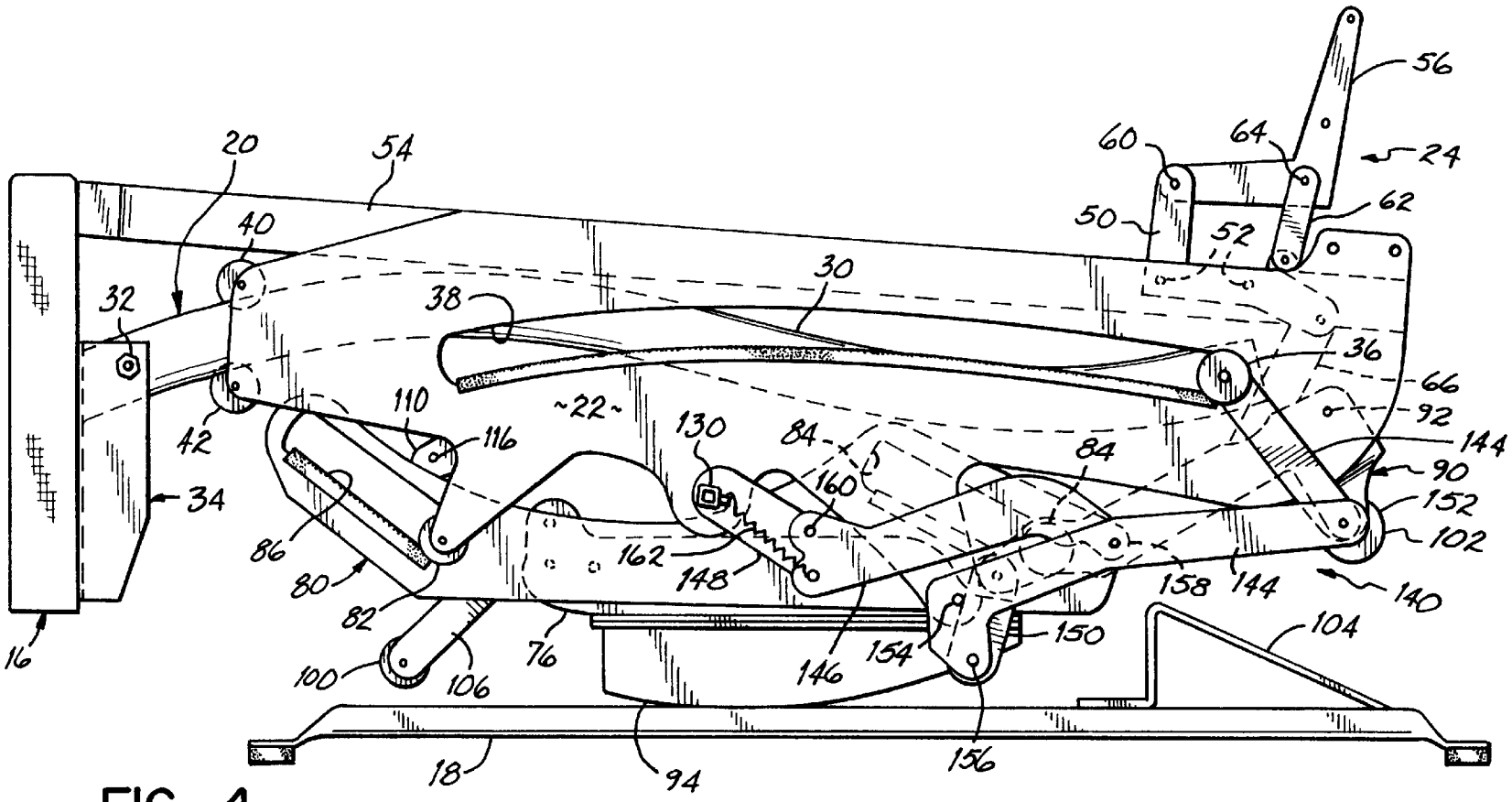
FIG. 4 is an elevational view similar to FIG. 1, but deleting the schematically illustrated seat and backrest for clarity and showing the reclining mechanism from an outside perspective.
Figure 5:
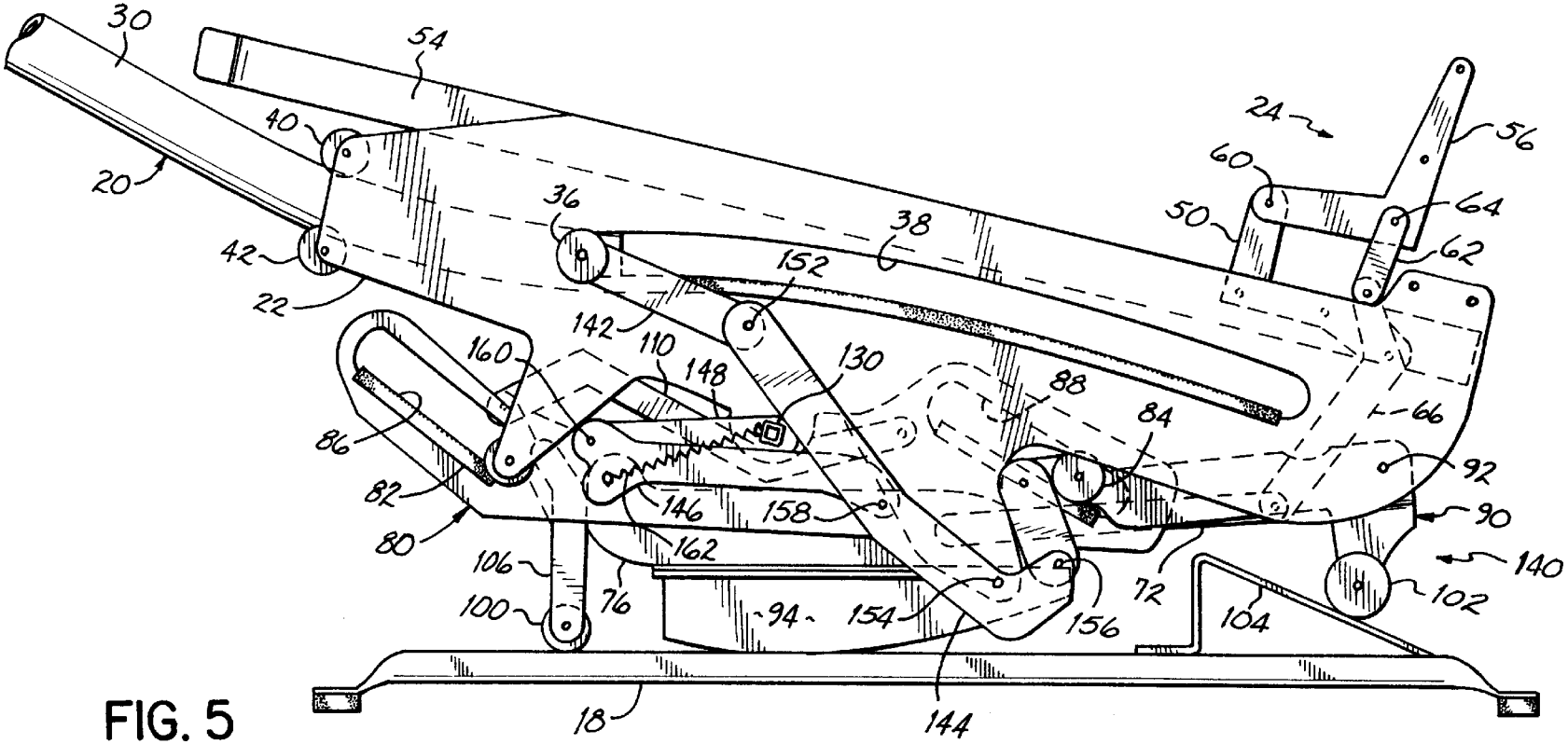
FIG. 5 is a fragmented elevational view similar to FIG. 4, but showing the mechanism in the intermediate reclined or T.V. position.
Figure 6:
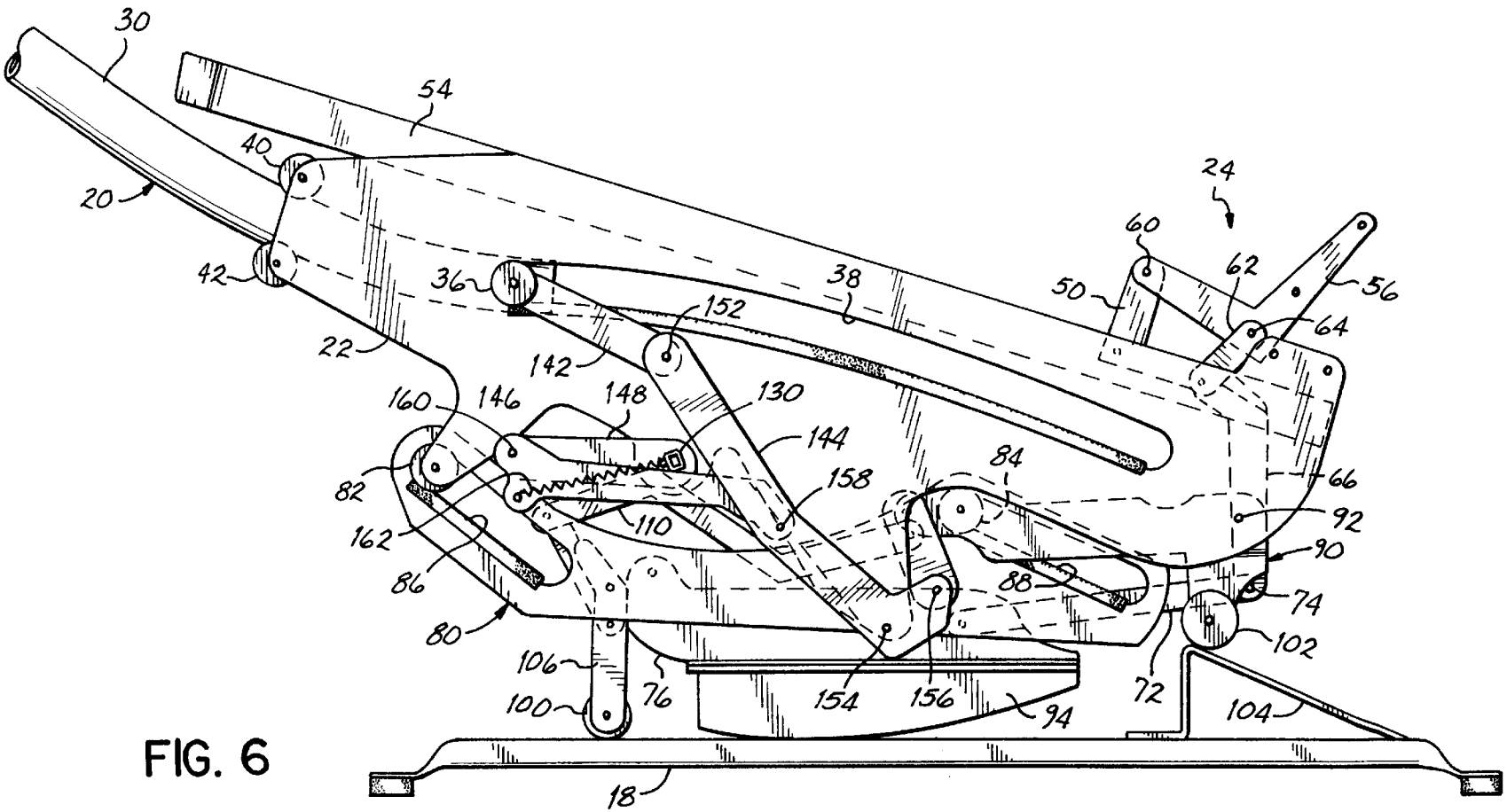
FIG. 6 is a fragmented elevational view similar to FIG. 5, but showing the reclining mechanism in a fully reclined position.

FIGS. 4–6 respectively illustrate the fully upright, intermediate reclined or T.V. and fully reclined positions of mechanism 20 from an outside or opposite side perspective. This better illustrates the actuating structure 140 for footrest 16. Actuating structure 140 preferably comprises links 142, 144, 146 connected for movement with a handle link 148. Handle line 148 is affixed for rotation with drive tube 130 and drive tube 130 may be connected with a handle (not shown), as described above, which is rotated by a seat occupant. A link 150 interconnects actuating structure 140 with link 90 extending to the opposite side of mechanism 20. More specifically, link 142 is pivotally connected to roller 36 at an upper end and connected to link 144 by a pivot connection 152 at a lower end. Link 144 is connected by a pivot connection 1 54 to seat link 22. Another pivot connection 156 connects link 144 to link 150. A pivot connection 157 connects an opposite end of link 150 to link 90. A pivot connection 158 disposed approximately midway along link 144 connects link 144 with link 146. Link 146 is connected to handle link 148 by a pivot connection 160. An extension spring 162 is connected between link 146 and drive tube 130 and serves to lock actuating structure 140 in the position shown in FIG. 4 to thereby lock mechanism 20 in the fully upright position.

Figure 7A:
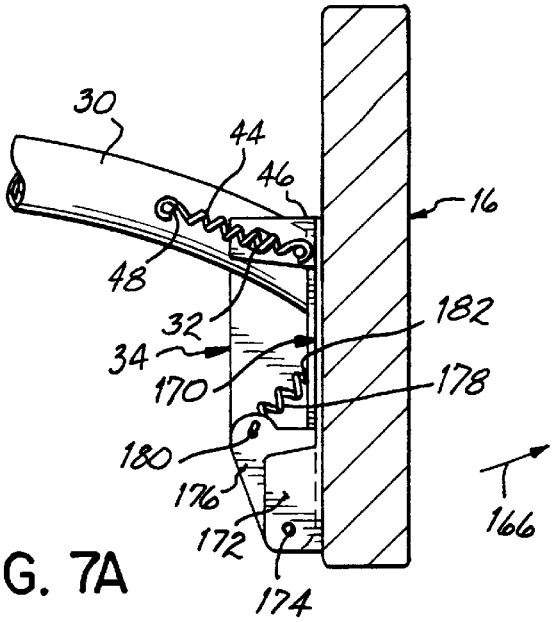
FIGS. 7A–7C are enlarged views of the footrest member showing the various positions and pivotal motions thereof.
Figure 7B:
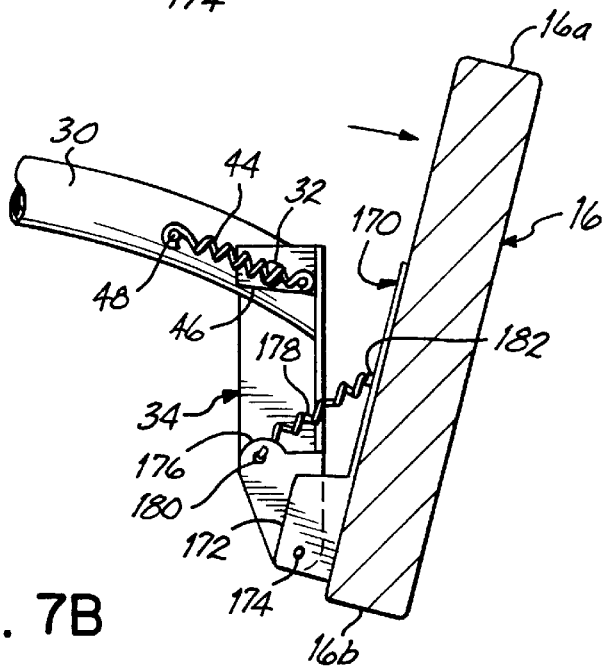
Figure 7C:
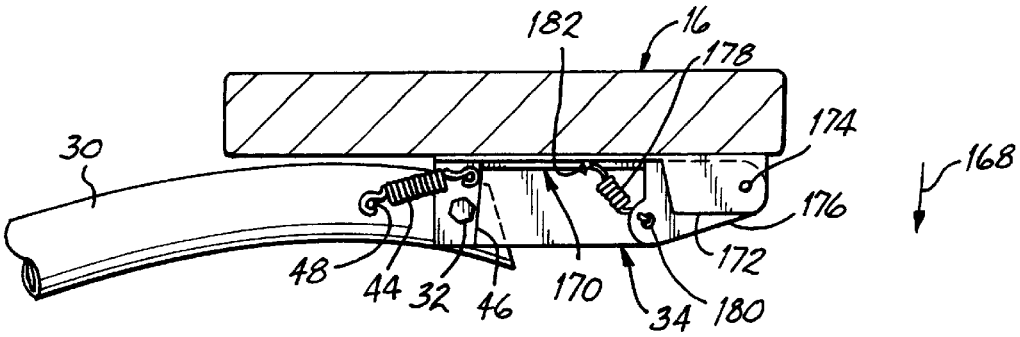

FIGS. 7A–7C illustrate the mounting and various possible movements of footrest 16 at the end of footrest support bar 30. As previously mentioned, footrest 16 is mounted on a support bracket 34 connected for pivotal movement on the end of support bar 30 by way of pivot 32. As shown in FIG. 7A, with footrest 16 in the retracted position, spring 44 is essentially on-center with pivot 32. As footrest 16 is extended, spring 44 moves to an over-center position as shown in FIG. 7C thereby automatically flipping footrest 16 into a leg supporting position in the direction of arrow 166 (FIG. 7A). In this position, spring 44 and pivot connection 32 allow a floating, pivoting motion in the clockwise direction of arrow 168 to provide more comfortable leg support to the seat occupant. As further shown in FIG. 7B, footrest 16 is further affixed to a mounting plate or other member 170 having a mounting portion 172. Mounting portion 172 is connected by a pivot 174 to a portion 176 of footrest bracket 34. A second spring 178 extends from a hole 180 in bracket portion 176 to a tab 182 disposed on mounting plate 170. This provides the counterclockwise spring-biased movement referenced by arrow 184 in FIG. 7B. This allows a rear edge **16*a* of footrest 16 to rotate outward from the furniture item with respect to a front edge 16*b* when footrest 16 is in the retracted, vertically oriented position. Therefore, footrest 16 will pivot away from any object or body part entrapped between footrest 16 and the remainder of the furniture item when moving into the fully upright position. This pivoting motion occurs without interference from the remainder of furniture item 10 (FIG. 1**).

Operating furniture item 10 to move between three different positions will be understood generally with reference to FIGS. 1–6. In the fully upright position shown in FIGS. 1 and 4, footrest 16 is maintained in a generally vertical orientation, but may pivot as shown in FIG. 7B. In this embodiment, furniture item 10 is shown as a rocker and may rock back and forth on element 94 when in the fully upright position. To move furniture item 10 to the intermediate reclined or T.V. position shown in FIGS. 2 and 5, the seat occupant rotates a handle affixed to drive tube 130 to thereby rotate handle link 148 clockwise, as viewed in FIG. 4, to the position shown in FIG. 5. As further shown in FIG. 2, rollers 100, 102 move into engaged positions in front of and behind rocker 94 to prevent rocking motion in both the intermediate and fully reclined positions. The rotation of handle link 148 pulls link 146 forward and rotates link 144 counterclockwise about pivot 154. At the same time, roller 36 attached with link 142 travels along slot 30 until reaching the front end slot 30 as shown in FIG. 5.

As further shown in FIG. 5, the above-described movement of actuating structure 140 extends footrest support bar 30 and footrest 16 as best shown in FIG. 2. Footrest 16 initially moves downward and then moves in an upward arc to the extended position. During extension, footrest 16 is also pivoted about pivot connection 32 to the generally horizontal orientation shown in FIG. 2. This occurs by the over-center spring action discussed in connection with FIGS. 7A and 7C. During the extension of footrest support bar 30, the S-shape of bar 30 in concert with the shape of slot 38 imparts a natural and comfortable movement to footrest 16 between the retracted and extended positions. To further move mechanism 20 into the fully reclined position shown in FIGS. 3 and 6, the seat occupant applies reward pressure against backrest 12 (FIG. 1) thereby pivoting backrest link 56 as shown in FIG. 3. Through the backrest linkage 24 and the connection with base link 76 provided through link 72, this forces seat link 22 and the attached link 90 and rollers 82, 84 to move in a forward direction. Rollers 82, 84 travel up tracks 86, 88, while roller 102 travels up ramp 104. At the same time, drive tube 130 travels upward on link 110. The full reclining movement is stopped when rollers 82, 84 reach the ends of respective tracks 86, 88. To move back into the intermediate reclined or T.V. position, the seat occupant releases their weight from backrest 12 and, to move into the fully upright position, the handle (not shown) and the connected drive tube are rotated in a direction opposite to the actuating direction. This reverses the arc-shaped extension motion of footrest 16. Also, toward the end of its retraction, footrest 16 will move briefly upward to tuck underneath seat 14 in a generally vertical orientation.

While the present invention has been illustrated by a description of a preferred embodiment and while this embodiment have been described in considerable detail in order to describe the best mode of practicing the invention, it is not the intention of applicant to restrict or in any way limit the scope of the appended claims to such detail. As some examples, the various linkage configurations, connections, etc., may differ significantly from mechanism to mechanism. A connection between two elements need not be a direct connection but may be a connection made through other structure. Also, with respect to the S-shaped section of the footrest support bar or the contemplated S-shaped track, although the preferred support bar is shown with an overall gradual, continuously curving S-shape, this term is meant to include other generally S-shaped configurations, including those having straight end portions, for example, or other curving portions. In combination with the curved track, the disclosed configuration is deemed to provide a desirable footrest movement. The configuration also functions well if the track is generally straightened except for a downwardly curved front end portion. Other combinations of curved track and support bar sections, for example, in combination with a linkage assembly may work as well while retaining the general inventive apparatus and method. Additional advantages and modifications within the spirit and scope of the invention will readily appear to those skilled in the art.

The invention itself should only be defined by the appended claims, wherein it is claimed:

1. A reclining mechanism for a furniture item to allow movement of the furniture item between upright and reclined positions, the reclining mechanism comprising:

support structure adapted for attachment to the furniture item, linkage coupled with said support structure and operative to move the furniture item between the upright and reclined positions, a footrest support bar connected for longitudinal movement with respect to the support structure between extended and retracted positions, the footrest support bar having an S-shaped section located between first and second ends, said first end adapted for connection to a footrest member for supporting legs of a seat occupant, and actuating structure connected with said footrest support bar and operable to move said footrest support bar along said S-shaped section between said extended and retracted positions.

2. The reclining mechanism of claim 1, wherein the footrest support bar includes at least one roller attached for rotation thereto and the support structure further includes a track, said roller being mounted for movement along said track between the extended and retracted positions.

3. The reclining mechanism of claim 2, wherein said track includes first and second ends and at least one curved section between the first and second ends.

4. The reclining mechanism of claim 3, wherein the curved section of said track curves upward and then downward from a rear portion to a front portion thereof.

5. The reclining mechanism of claim 2, wherein the support structure includes a seat supporting member mounted adjacent the footrest support bar in a manner allowing said actuating structure to travel along said track as the footrest support bar moves between the extended and retracted positions.

6. The reclining mechanism of claim 2, wherein the roller is attached proximate the second end of said footrest support bar.

7. The reclining mechanism of claim 6, wherein the track includes first and second stops and said roller engages said stops at the respective upright and reclined positions.

8. The reclining mechanism of claim 2, wherein the roller is further connected for movement with said actuating structure along said track.

9. The reclining mechanism of claim 2 further comprising at least a second roller connected with the support structure adjacent said footrest support bar, said second roller engaging the footrest support bar during movement between the extended and retracted positions.

10. The reclining mechanism of claim 2 further comprising upper and lower rollers connected with the support structure adjacent the footrest support bar, said upper and lower rollers supporting and guiding said footrest support bar during movement between the extended and retracted positions.

11. The reclining mechanism of claim 1 further comprising a rocker element connected with the support structure to allow rocking of the furniture item by an occupant.

12. A three way reclining mechanism for moving an item of furniture between upright, intermediate reclined and fully reclined positions, the mechanism comprising:

a base member, seat supporting linkage, backrest linkage connected to a rear end of said seat supporting linkage and including a pivoting backrest link for attachment to a backrest and operable to pivot with respect to said seat supporting linkage, an S-shaped footrest support bar connected to a forward end of said seat supporting linkage to allow extension and retraction of said footrest support bar, and actuating structure connected with said S-shaped footrest support bar for moving the S-shaped footrest support bar between extended and retracted positions as said mechanism moves between the upright position and the intermediate reclined position.

13. The reclining mechanism of claim 12, wherein the footrest support bar includes at least one roller attached for rotation thereto and the seat supporting linkage includes a track, said roller being mounted for movement along said track between the extended and retracted positions.

14. The reclining mechanism of claim 13, wherein said track includes first and second ends and at least one curved section between the first and second ends.

15. The reclining mechanism of claim 14, wherein the curved section of said track curves upward and then downward from a rear portion to a front portion thereof.

16. The reclining mechanism of claim 13, wherein the seat supporting linkage is mounted adjacent the footrest support bar in a manner allowing said actuating structure to travel along said track as the footrest support bar moves between the extended and retracted positions.

17. The reclining mechanism of claim 13, wherein the roller is attached proximate the second end of the footrest support bar.

18. The reclining mechanism of claim 17, wherein the track includes first and second stops and said roller engages said stops at the respective upright and reclined positions.

19. The reclining mechanism of claim 13, wherein the roller is further connected with said actuating structure for movement by said actuating structure along said track.

20. The reclining mechanism of claim 13 further comprising at least a second roller connected with the seat supporting linkage adjacent said footrest support bar, said second roller engaging the footrest support bar during movement between the extended and retracted positions.

21. The reclining mechanism of claim 13 further comprising upper and lower rollers connected with the seat supporting linkage adjacent the footrest support bar, said upper and lower support rollers supporting and guiding the footrest support bar during movement between the extended and retracted positions.

22. The reclining mechanism of claim 12 further comprising a rocker element connected with the seat supporting linkage to allow rocking of the furniture item by an occupant.

23. A reclining mechanism for a furniture item to allow movement of the furniture item between upright and reclined positions, the reclining mechanism comprising:

support structure adapted for attachment to the furniture item, a track connected with the support structure, a footrest support bar connected with said track for longitudinal movement with respect to the support structure between extended and retracted positions, at least one of said track and said footrest support bar having an S-shaped section, and actuating structure connected with said footrest support bar and operable to move said footrest support bar along said S-shaped section between said extended and retracted positions.

24. A reclining furniture item movable between upright, intermediate reclined and fully reclined positions, the furniture item comprising:

a base member;

a backrest, a seat and a footrest connected for movement with respect to said base member by a pair of reclining mechanisms, each reclining mechanism including:

i) seat supporting linkage including a seat link connected to said seat, ii) backrest linkage connected to a rear end of said seat supporting linkage and including a pivoting backrest link connected to said backrest and operable to allow pivoting of said backrest with respect to said seat, iii) a track connected with said seat link, iv) a footrest support bar connected to a forward end of said seat supporting linkage and connected with said footrest to allow extension and retraction of said footrest when moving between the upright position and the intermediate reclined position, at least one of said track and said footrest support bar having an S-shaped section, and v) actuating structure connected with said footrest support bar for moving the footrest support bar along said S-shaped section between extended and retracted positions as said furniture item moves between the upright position and the intermediate reclined position.

25. The reclining furniture item of claim 24, wherein the footrest further comprises:

a leg supporting member, a mounting member connected with said leg supporting member, a support member connected with said mounting member in a spring-biased pivotal manner and further connected to said footrest support bar in a spring-biased pivotal manner, whereby the leg supporting member is pivotal in a spring-biased manner in both clockwise and counterclockwise directions.

26. A reclining mechanism for a furniture item to allow movement of the furniture item by an occupant between upright and reclined positions, the reclining mechanism comprising:

support structure adapted for attachment to the furniture item, footrest actuating structure connected with said support structure and operable by the furniture occupant, and a footrest member connected to the footrest actuating structure for movement between a retracted position and an extended, leg supporting position for supporting legs of the occupant, wherein said footrest member is connected by at least one spring to said footrest actuating structure, said spring mounted for movement into an over-center position for pivoting the footrest member into the leg supporting position upon extension thereof.

27. A reclining mechanism for a furniture item to allow movement of the furniture item by an occupant between upright and reclined positions, the reclining mechanism comprising:

support structure adapted for attachment to the furniture item, footrest actuating structure connected with said support structure and operable by the furniture occupant, and a footrest member having a rear edge and a front edge, the foot rest member connected to the footrest actuating structure for movement between a retracted position with the rear edge above the front edge and an extended, leg supporting position with the rear edge behind the front edge, wherein said footrest member is pivotally connected to said footrest actuating structure in a spring-biased manner allowing pivoting, spring-biased motion in two directions whereby the front edge is pivotal downward in the leg supporting position and the rear edge is pivotal outward in the retracted position.

28. A furniture item comprising:

a base, a seat, a backrest coupled with said seat and said base to form a seating area for an occupant of the furniture item, a footrest mechanism including:

a footrest member, a footrest support bar connected for movement with respect to the base between extended and retracted positions, the footrest support bar having first and second ends, said first end coupled with said footrest member for supporting legs of a seat occupant in the extended position and said second end being positioned generally adjacent and below a front edge of the seat when disposed in the extended position, and actuating structure connected with said footrest support bar and operable to move said footrest support bar between the extended and retracted positions, wherein movement from the retracted position to the extended position includes an initial downward and outward movement of the footrest member followed by an upward and outward movement through an arc.

29. A furniture item comprising:

a base, a seat, a backrest coupled with said seat and said base to form a seating area for an occupant of the furniture item, a footrest mechanism including:

a footrest member, a track connected with the base, a footrest support bar having first and second ends, said first end connected to said footrest member and said second end connected with said track for longitudinal movement with respect to the base between retracted and extended positions, said second end being positioned generally adjacent and below a front edge of the seat when disposed in the extended position, said track and said footrest support bar having configurations that cooperate to produce a movement of said footrest member from the retracted position to the extended position, said movement including an initial downward and outward movement followed by an upward and outward movement through an arc, and actuating structure connected with said footrest support bar and operable to move said footrest support bar between said extended and retracted positions.

30. A reclining mechanism for a furniture item having a seat and a backrest and allowing movement of the furniture item between upright and reclined positions, the reclining mechanism comprising:

support structure adapted for attachment to the furniture item, linkage coupled with said support structure and operative to move the seat and backrest between the upright and reclined positions, a footrest support bar connected for movement with respect to the support structure between extended and retracted positions, the footrest support bar having first and second ends, said first end adapted for connection to a footrest member for supporting legs of a seat occupant and said second end being positioned generally adjacent and below a front edge of the seat when connected to said furniture item and disposed in the extended position, and actuating structure connected with said footrest support bar and operable to move said footrest support bar between the extended and retracted positions, wherein movement from the retracted position to the extended position includes an initial downward and outward movement followed by an upward and outward movement through an arc.

31. The reclining mechanism of claim 30 further comprising said footrest member pivotally connected to the first end of said footrest support bar and pivotal from a generally vertical orientation in the retracted position to a generally horizontal position in the extended position.

32. The reclining mechanism of claim 31, wherein said footrest member includes an upper edge and a lower edge when in the retracted position and said footrest member is biased such that the lower edge pivots outwardly as the footrest support bar is moved from the retracted position toward the extended position.

* * * * *